US006107728A

United States Patent [19]

Spindt et al.

[11] Patent Number: 6,107,728

[45] **Date of Patent: *Aug. 22, 2000**

[54] STRUCTURE AND FABRICATION OF ELECTRON-EMITTING DEVICE HAVING ELECTRODE WITH OPENINGS THAT FACILITATE SHORT-CIRCUIT REPAIR

[75] Inventors: Christopher J. Spindt, Menlo Park; John E. Field, Dorrington; Theodore S. Fahlen, San Jose, all of Calif.

[73] Assignee: Candescent Technologies Corporation, San Jose, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/071,465

[22] Filed: Apr. 30, 1998

[51] Int. Cl.[7] ..... H01J 1/30; H01J 1/02

[52] U.S. Cl. ..... 313/310; 313/309; 313/495

[58] Field of Search ..... 313/309, 310, 313/336, 351, 422, 452, 495, 496, 497

[56] References Cited

U.S. PATENT DOCUMENTS

| | | | |
|---|---|---|---|
| 4,874,981 | 10/1989 | Spindt | 313/309 |
| 4,940,916 | 7/1990 | Borel et al. | 313/306 |
| 5,191,217 | 3/1993 | Kane et al. | 313/308 |
| 5,374,868 | 12/1994 | Tjaden et al. | 313/310 |
| 5,528,103 | 6/1996 | Spindt et al. | 313/497 |
| 5,543,683 | 8/1996 | Haven et al. | 313/461 |
| 5,559,389 | 9/1996 | Spindt et al. | 313/310 |
| 5,564,959 | 10/1996 | Spindt et al. | 445/24 |
| 5,569,975 | 10/1996 | Taylor et al. | 313/310 |
| 5,589,728 | 12/1996 | Levine et al. | 313/336 |
| 5,621,272 | 4/1997 | Levine et al. | 313/422 |
| 5,631,518 | 5/1997 | Barker | 313/308 |
| 5,649,847 | 7/1997 | Haven | 445/24 |
| 5,650,690 | 7/1997 | Haven | 313/422 |
| 5,672,933 | 9/1997 | Wilson et al. | 313/336 |
| 5,686,782 | 11/1997 | Hecker, Jr. et al. | 313/309 |
| 5,717,275 | 2/1998 | Takemura | 313/309 |
| B1 4,940,916 | 11/1994 | Borel et al. | 313/306 |

FOREIGN PATENT DOCUMENTS

WO 92/09095 5/1992 WIPO .

OTHER PUBLICATIONS

Kim et al, "High–Aperture and Fault–Tolerant Pixel Structure for TFT–LCDs", *SID 95 Digest,* 1995, pp. 15–18.

Busta, "Vacuum Microelectronics–1992", *J. Micromech. Microeng.,* vol. 2, 1992, pp. 43–74.

*Primary Examiner*—Vip Patel
*Assistant Examiner*—Matthew Gerike
*Attorney, Agent, or Firm*—Skjerven, Morrill, MacPherson, Franklin & Friel, LLP; Ronald J. Meetin

[57] ABSTRACT

An electrode (12 or 30) of an electron-emitting device has a plurality of openings (16 or 60) spaced laterally apart from one another. The openings can be used, as needed, in selectively separating one or more parts of the electrode from the remainder of the electrode during corrective test directed towards repairing any short-circuit defects that may exist between the electrode and other overlying or underlying electrodes. When the electrode with the openings is an emitter electrode (12), each opening (16) normally extends fully across an overlying control electrode (30). When the electrode with the openings is a control electrode (30), each opening (60) normally extends fully across an underlying emitter electrode (12). The short-circuit repair procedure typically entails directing light energy on appropriate portions of the electrode with the openings.

56 Claims, 7 Drawing Sheets

STRUCTURE AND FABRICATION OF ELECTRON-EMITTING DEVICE HAVING ELECTRODE WITH OPENINGS THAT FACILITATE SHORT-CIRCUIT REPAIR

FIELD OF USE

This invention relates to electron-emitting devices. In particular, this invention relates to the structure and fabrication, including repair, of an electron-emitting device suitable for use in a flat-panel display of the cathode-ray tube ("CRT") type.

BACKGROUND

A flat-panel CRT display basically consists of an electron-emitting device and a light-emitting device that operate at low internal pressure. The electron-emitting device, commonly referred to as a cathode, contains electron-emissive elements that selectively emit electrons over a relatively wide area. The emitted electrons are directed towards light-emissive elements distributed over a corresponding area in the light-emitting device. Upon being struck by the electrons, the light-emissive elements emit light that produces an image on the viewing surface of the display.

The electron-emissive elements are conventionally situated over generally parallel emitter electrodes. In a matrix-addressed electron-emitting device that operates according to field-emission principles, generally parallel control electrodes cross over, and are electrically insulated from, the emitter electrodes. A set of electron-emissive elements are electrically coupled to each emitter electrode at each crossing with one of the control electrodes. The electron-emissive elements are exposed through openings in the control electrodes. When a suitable voltage is applied between a control electrode and an emitter electrode, the control electrode extracts electrons from the associated electron-emissive elements. An anode in the light-emitting device attracts the electrons to the light-emissive elements.

Short circuits sometime occur between the control electrodes, on one hand, and the emitter electrodes, on the other hand. The presence of a short circuit can have a very detrimental effect on the display's performance. For example, a short circuit at the crossing between a control electrode and an emitter electrode can prevent part or all of the set of electron-emissive elements associated with those two electrodes from operating properly. It would be desirable to have a way for configuring the emitter or/and control electrodes to facilitate removal of short-circuit defects.

GENERAL DISCLOSURE OF THE INVENTION

In the present invention, an electrode for an electron-emitting device is furnished with a plurality of openings spaced laterally apart from one another. The openings are available for use in selectively separating one or more parts of the electrode from the remainder of the electrode during corrective test directed towards removing any short-circuit defects that may exist between the electrode and other overlying or underlying electrodes.

According to one aspect of the invention, the electrode is an emitter electrode in which the openings are laterally separated in a primary direction. Each emitter-electrode opening has a pair of extreme points most separated in the primary direction. A plurality of laterally separated sets of electron-emissive elements are electrically coupled to the emitter electrode. Each of the sets of electron-emissive elements overlies a corresponding designated region of the emitter electrode. Each designated region has a centroid that lies between a pair of (imaginary) lines extending perpendicular to the primary direction respectively through the extreme points of a different corresponding one of the emitter-electrode openings. Configuring the emitter electrodes in this manner facilitates removal of control-electrode-to-emitter-electrode short-circuit defects.

More particularly, the emitter electrode is normally shaped roughly like a ladder having a pair of rails extending generally in the primary direction. Laterally separated crosspieces are situated between the rails and merge into them. The regions between consecutive crosspieces form the emitter-electrode openings. The designated emitter-electrode regions that respectively underlie the sets of electron-emissive elements are parts of one or both of the rails. As viewed perpendicular to the primary direction, each designated region is therefore a rail portion generally in line with the corresponding emitter-electrode opening.

The designated regions are typically all parts of one of the rails. In this case, the ladder is normally asymmetric. The rail having the designated regions is wider than the other rail. Hence, the emitter-electrode openings are offset relative to the outer longitudinal edges of the ladder.

A dielectric layer is normally provided over the emitter electrode. The electron-emissive elements are situated in openings in the dielectric layer. A plurality of control electrodes are provided over the dielectric layer. Each control electrode extends over a different corresponding one of the designated regions. The electron-emissive elements are exposed through openings in the control electrodes.

With the electron-emitting device configured in the foregoing manner, corrective test for removing any control-electrode-to-emitter-electrode short-circuit defect is performed by first examining the electron-emitting device to determine whether any control electrode appears to be short circuited to the emitter electrode. If so, an electrode portion containing the designated region corresponding to each short-circuited control electrode is separated from the emitter electrode by cutting partially across the emitter electrode at a pair of cut locations on opposite sides of that designated region. Both cut locations extend between the corresponding emitter-electrode opening and a longitudinal edge of the emitter electrode. The cutting operation is normally performed along emitter-electrode material not underlying each short-circuited control electrode.

A short-circuit defect between a control electrode and the emitter electrode normally occurs where the control electrode overlies the emitter-electrode portion that contains the designated region for the corresponding one of the sets of electron-emissive elements. By separating this emitter-electrode portion from the emitter electrode, the short-circuit defect is normally removed. At the same time, the emitter-electrode portion on the side of the emitter-electrode opening opposite the separated emitter-electrode portion remains intact to provide a current path through the emitter electrode across the location where the control electrode overlies the emitter electrode. Although the electron-emission capability is normally lost at the short-circuit location, the electron-emission capability survives at each other electron-emission location above the emitter electrode to the extent that no other control electrode is short circuited to the emitter electrode. Consequently, all the electron-emissive elements except those at short-circuit locations are normally capable of emitting electrons in the repaired device.

According to another aspect of the invention, a dielectric layer again overlies the emitter electrode having the laterally separated emitter-electrode openings. The emitter electrode is normally shaped roughly like a ladder, typically an asymmetric ladder, as described above. With electron-emissive elements situated in openings in the dielectric layer and exposed through openings in control electrodes overlying the dielectric layer, each control electrode crosses over the emitter electrode above a different corresponding one of the emitter-electrode openings. Importantly, each control electrode has a pair of outer longitudinal edges beyond both of which the corresponding emitter-electrode opening extends laterally. That is, as seen in plan view from the top or bottom side of the electron-emitting device, each emitter-electrode opening protrudes outward beyond both longitudinal edges of the corresponding control electrode.

Configuring the control electrodes in the foregoing manner relative to the emitter-electrode openings facilitates removal of short-circuit defects at the locations where the control electrodes cross over the emitter electrode. By having each emitter-electrode opening protrude outward beyond both longitudinal edges of the corresponding control electrode, a cutting operation to remove a short-circuit defect between a control electrode and the emitter electrode is conveniently performed at a pair of cut locations on opposite sides of each short-circuited control electrode. Both cut locations extend between the corresponding emitter-electrode opening and a specified longitudinal edge of the emitter electrode. The emitter-electrode portion bounded by (a) the cut locations, (b) the specified longitudinal edge of the emitter electrode, and (c) the corresponding emitter-electrode opening is thereby separated from the emitter electrode. Consequently, the short-circuit defect is normally repaired.

The short-circuit removal operation is typically performed by directing light energy on the emitter electrode at the location of each desired cut. Since the cuts are made away from the sides of each short-circuited control electrode, use of light energy to perform the cutting operation normally poses a low risk of damage to the control electrode. The light energy can be directed on the emitter electrode from above or below depending on the materials employed to form the other components of the electron-emitting device. Also, the short-circuit removal operation can be performed after assembling the electron-emitting device and a light-emitting device to form a display.

According to a further aspect of the invention, the roles of the emitter and control electrodes are reversed. In other words, a control electrode is provided with openings for use in repairing short-circuit defects. The control electrode is typically configured generally the same as described above for the emitter electrode. With a plurality of laterally separated sets of electron-emissive elements exposed through further openings in the control electrode, the control-electrode openings utilized in short-circuit repair are referred to as primary control-electrode openings.

A dielectric layer underlies the control electrode, the electron-emissive elements again being situated largely in dielectric openings in the dielectric layer. A plurality of emitter electrodes underlie the electron-emissive elements. Each emitter electrode crosses under the control electrode below a different corresponding one of the primary control-electrode openings. Each primary control-electrode opening extends laterally beyond the corresponding emitter electrode.

Upon determining that a short-circuit defect exists between the control electrode and an emitter electrode, a cutting operation is performed on the control electrode at cut locations on opposite sides of the short-circuited emitter electrode. The cut locations extend between the corresponding primary control-electrode opening and a specified longitudinal edge of the control electrode. The control-electrode portion bounded by (a) the cut locations, (b) the specified longitudinal edge of the control electrode, and (c) the corresponding primary control-electrode opening is thereby separated from the control electrode to repair the short-circuit defect. Once again, light energy is typically utilized to perform the cuts.

By facilitating removal of short-circuit defects, the invention increases the fabrication yield. The invention thus provides a significant advance.

BRIEF DESCRIPTION OF DRAWINGS

Like reference symbols are employed in the drawings and in the description of the preferred embodiments to represent the same, or very similar, item or items.

DESCRIPTION OF THE PREFERRED EMBODIMENTS

The present invention furnishes a matrix-addressed gated electron-emitting device having a layer of emitter electrodes which, in plan (or layout) view, are shaped generally like asymmetric ladders. With respect to the emitter electrodes, "plan view" means as viewed in a direction generally perpendicular to the emitter-electrode layer. The electron emitter of the invention typically operates according to field-emission principles in producing electrons that cause visible light to be emitted from corresponding light-emissive phosphor elements of a light-emitting device. The combination of the electron-emitting and light-emitting devices forms a cathode-ray tube of a flat-panel display such as a flat-panel television or a flat-panel video monitor for a personal computer, a lap-top computer, or a workstation.

In the following description, the term "electrically insulating" (or "dielectric") generally applies to materials having a resistivity greater than $10^{10}$ ohm-cm. The term "electrically non-insulating" thus refers to materials having a resistivity below $10^{10}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{10}$ ohm-cm. Similarly, the term "electrically non-conductive" refers to materials having a resistivity of at least 1 ohm-cm, and includes electrically resistive and electrically insulating materials. These categories are determined at an electric field of no more than 10 volts/$\mu$m.

Figure 1:
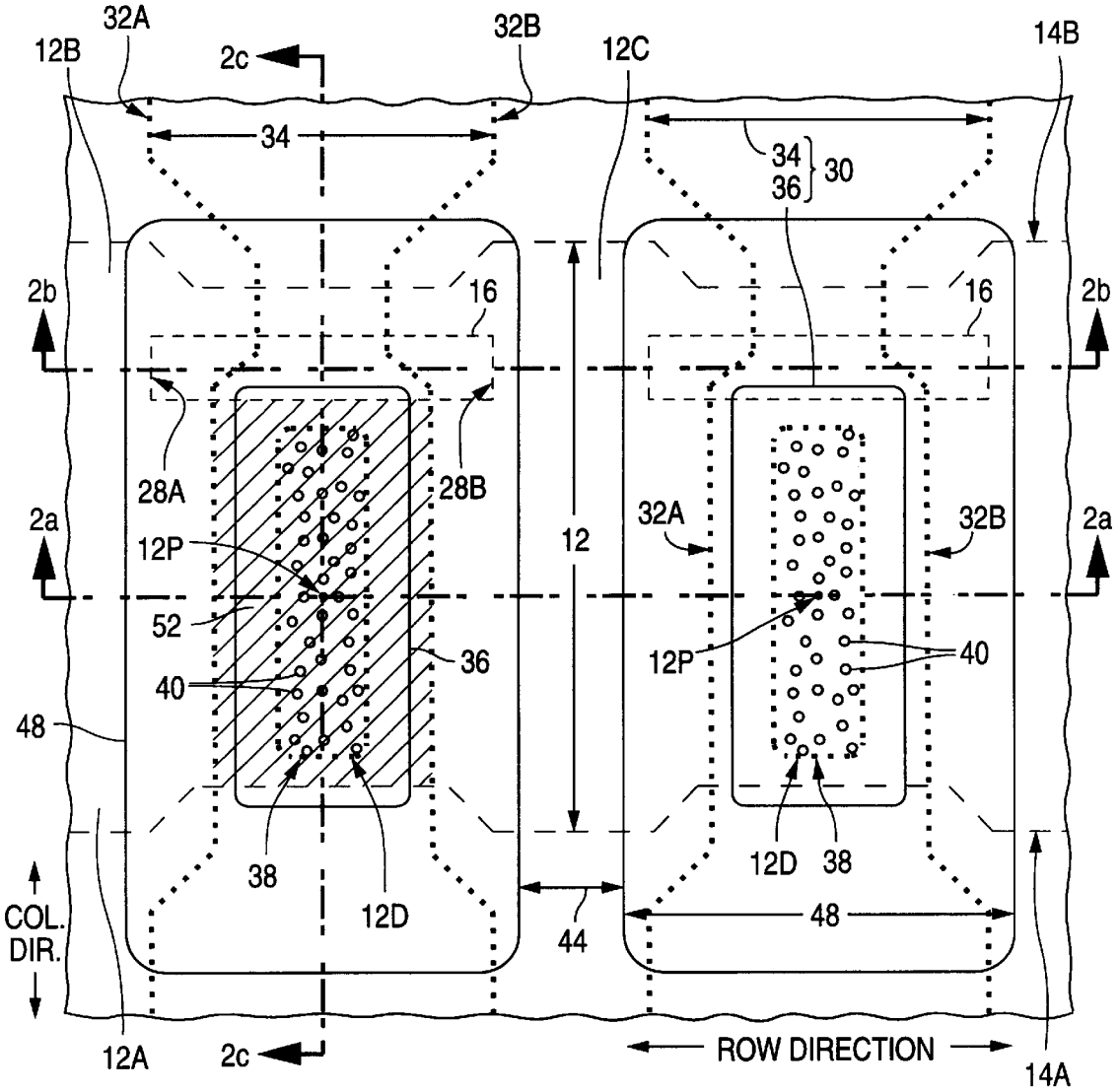
FIG. 1 is a plan view of a portion of an electron-emitting device configured according to the invention to have an emitter electrode generally shaped like an asymmetric ladder.
Figure 2A:
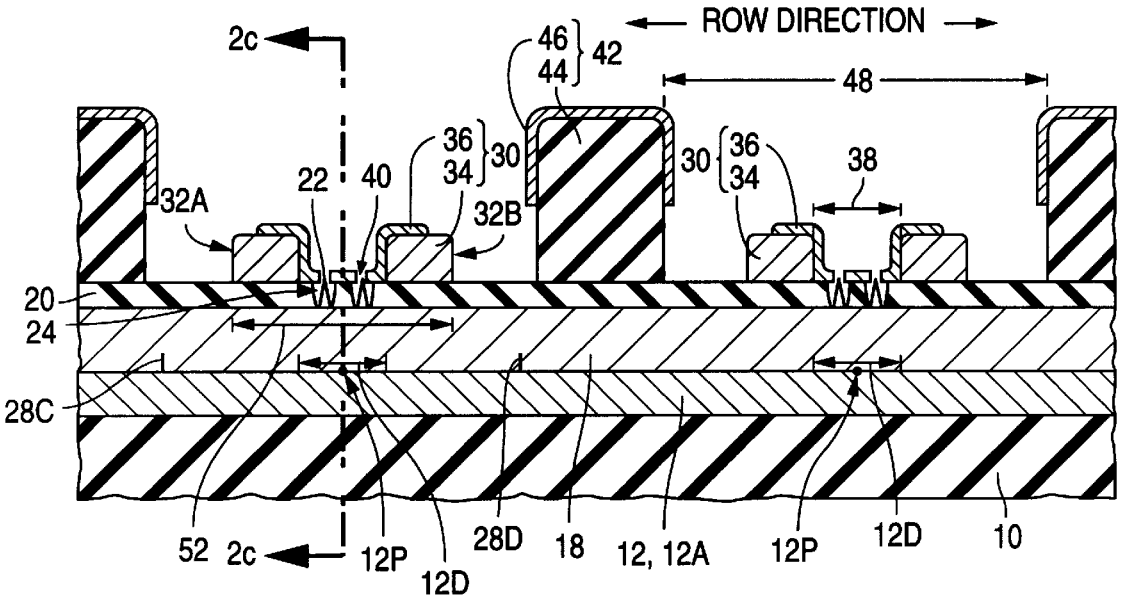
FIGS. 2*a*, 2*b*, and 2*c* are cross-sectional side views of the portion of the electron-emitting device in FIG. 1. The cross section of FIG. 2*a* is taken through plane 2*a*—2*a* in FIGS. 1 and 2*c*. The cross section of FIG. 2*b* is taken through plane 2*b*—2*b* in FIGS. 1 and 2*c*. The cross section of FIG. 2*c* is taken through plane 2*c*—2*c* in FIGS. 1, 2*a*, and 2*b*.
Figure 2B:
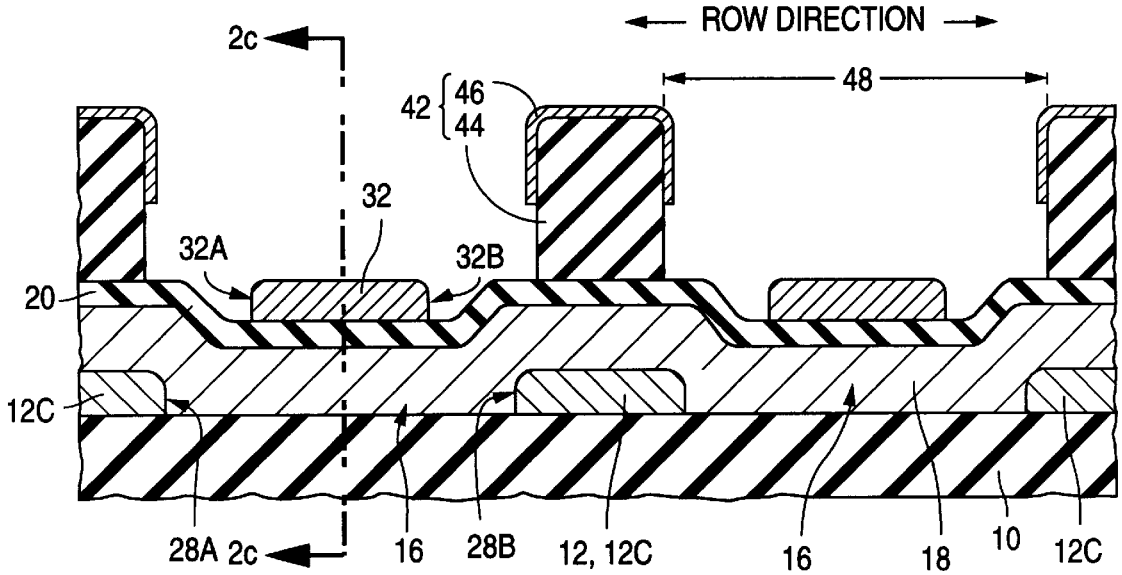
Figure 2C:
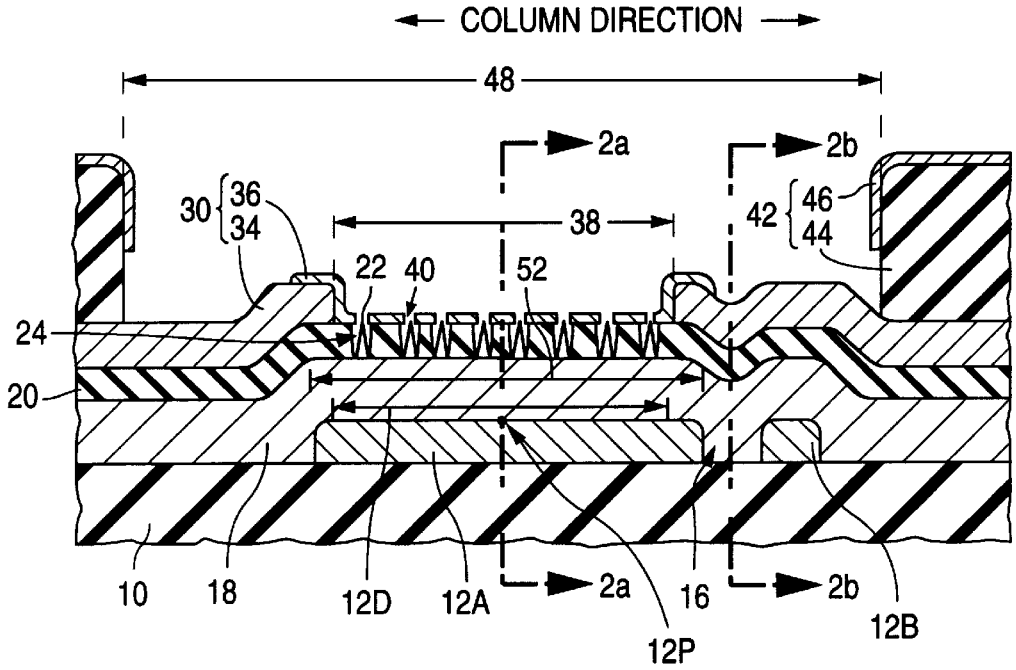

Referring to the drawings, FIG. 1 illustrates a plan view of part of a matrix-addressed gated electron-emitting device having emitter electrodes configured according to the invention to facilitate removal of cross-over short-circuit defects. The electron-emitting device in FIG. 1 operates in field-emission mode and is often referred to here as a field emitter. FIGS. 2*a*–2*c* depict side cross sections of the part of the field emitter shown in FIG. 1. The cross sections of FIGS. 2*a* and 2*b* are taken through planes parallel to each other and perpendicular to the plane of the cross section of FIG. 2*c*. To simplify the illustration, lateral dimensions in FIGS. 2*a*–2*c* are illustrated at a compressed scale compared to vertical dimensions.

The field emitter of FIGS. 1 and 2*a*–2*c* is employed in a color flat-panel CRT display divided into rows and columns of color picture elements ("pixels"). The row direction—i.e., the direction along the rows of pixels—is the horizontal direction in FIGS. 1, 2*a*, and 2*b*. The column direction, which extends perpendicular to the row direction and thus along the columns of pixels, extends vertically in FIG. 1 and horizontally in FIG. 2*c*. Each color pixel contains three sub-pixels, one for red, another for green, and the third for blue.

The field emitter of FIGS. 1 and 2 is created from a thin transparent flat baseplate 10 typically consisting of glass approximately 1 mm in thickness. A group of opaque generally parallel, laterally separated emitter electrodes 12 are situated on baseplate 10. Emitter electrodes 12 extend generally in the row direction and thus constitute row electrodes. FIGS. 1 and 2*a*–2*c* depict one emitter electrode 12. In FIG. 1, the lateral boundary of illustrated electrode 12 is shown in dashed lines.

Figure 3:
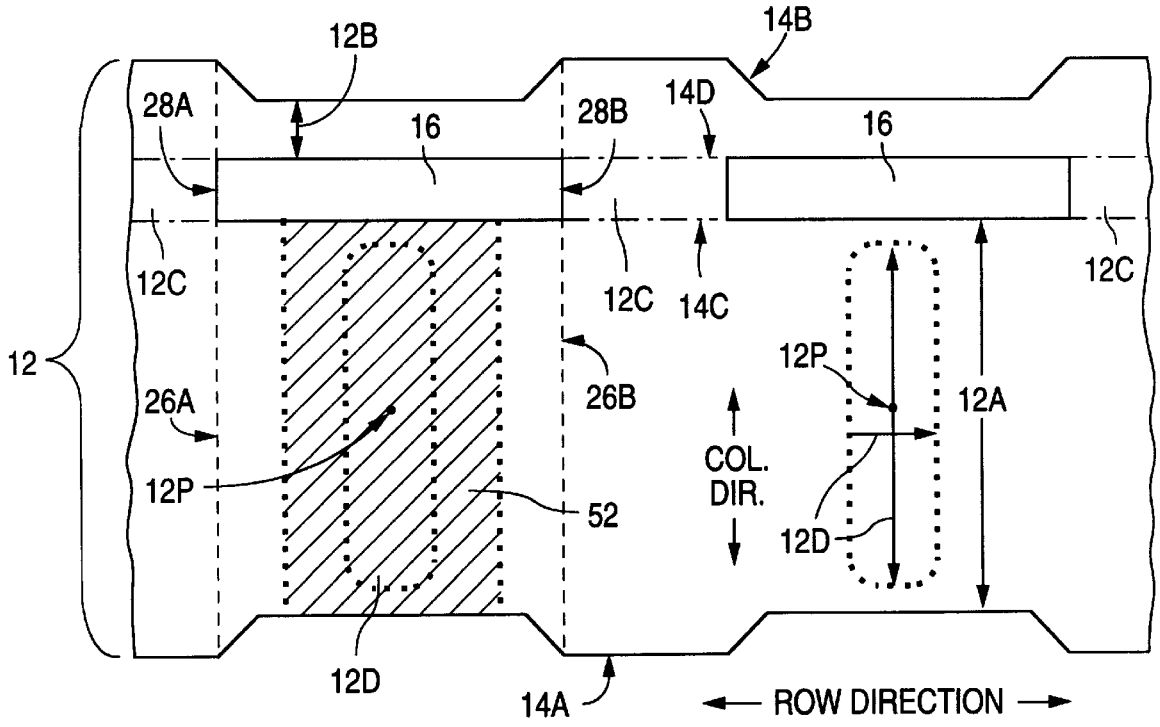
FIG. 3 is a plan view of the portion of one of the emitter electrodes in the electron-emitting device of FIG. 1.

FIG. 3, oriented the same as FIG. 1, illustrates the plan-view shape of one emitter electrode 12 more clearly. As indicated by FIG. 3, each emitter electrode 12 is generally in the shape of a asymmetric ladder consisting of a pair of generally parallel rails 12A and 12B and a group of crosspieces 12C that extend between rails 12A and 12B. The internal lateral extents of rails 12A and 12B and crosspieces 12C are indicated by dot-and-dash lines in FIG. 3.

Rails 12A and 12B of each emitter electrode 12 extend in the row direction. The outer longitudinal edges of rails 12A and 12B are respectively indicated as items 14A and 14B in FIG. 3. Longitudinal edges 14A and 14B, which also form the outer longitudinal edges of emitter electrode 12, can be straight or, as shown in the example of FIG. 3, curved. In any event, rail 12A is of considerably greater average width, as measured in the column direction, than rail 12B.

Each crosspiece 12C has a pair of opposite edges that merge seamlessly into rails 12A and 12B respectively along inner longitudinal rail edges 14C and 14D of each emitter electrode 12. The regions between crosspieces 12C of each emitter electrode 12 constitute emitter-electrode openings 16 that extend fully through that electrode 12. Emitter-electrode openings 16 are laterally separated from one another in the row direction. During the corrective test procedure directed towards removing any short-circuit defects that may exist between emitter electrodes 12 and the below-described control electrodes, emitter-electrode openings 16 furnish a capability that facilitates selectively removing, as necessary, one or more parts of each emitter electrode 12 from the remainder of that electrode 12 without significantly impairing the current-carrying capability of emitter electrodes 12 or the control electrodes.

In the example of FIGS. 1 and 3, emitter-electrode openings 16 in each emitter electrode 12 are generally rectangular and extend in a straight line to form a row. Because rail 12A is wider than rail 12B, emitter-electrode openings 16 are offset relative to electrode 12. That is, openings 16 are closer to outer emitter-electrode longitudinal edge 14B than to outer emitter-electrode longitudinal edge 14A.

Emitter-electrode openings 16 are all of approximately the same dimensions. Each emitter-electrode opening 16 normally has a width in the column direction of 5–20 $\mu$m, typically 15 $\mu$m. Each opening 16 normally has a length in the row direction of 10–100 $\mu$m, typically 70 $\mu$m. Openings 16 are normally spaced approximately equidistant from one another in the row direction. The row-direction centerpoint-to-centerpoint spacing of openings 16 is normally 80–120 $\mu$m, typically 100 $\mu$m.

The centerline-to-centerline spacing between the longitudinal centerlines (not shown) of emitter electrodes 12 is normally 240–360 $\mu$m, typically 300 $\mu$m. Each of rails 12A and 12B reaches a minimum width along emitter-electrode openings 16. The minimum width of rail 12A is normally 100–200 $\mu$m, typically 150 $\mu$m. The minimum width of rail 12B is normally 5–20 $\mu$m, typically 10 $\mu$m.

Rails 12A and 12B and crosspieces 12C are typically of approximately the same thickness. Emitter electrodes 12 typically consist of metal such as an alloy of nickel or aluminum. In this case, the thickness of electrodes 12 is typically 100–200 nm. Electrodes 12 can alternatively be formed with chromium, gold, copper, molybdenum, or another corrosion-resistant metal of high electrical conductivity.

An electrically resistive layer 18 is situated on emitter electrodes 12. Resistive layer 18 extends down to baseplate 10 in emitter-electrode openings 16. The thickness of layer 18 is typically 0.2–0.5 $\mu$m.

Resistive layer 18 may be a blanket layer or a patterned layer as, for example, described in Cleeves et al, U.S. patent application Ser. No. 08/962,230, filed Oct. 31, 1997, now allowed. In either case, the resistive material of layer 18 overlies emitter electrodes 12 below the locations of the electron-emissive elements. Configuring layer 18 as a blanket layer or, in some cases, as a patterned layer may seem to electrically intercouple different emitter electrodes 12. The resistance of such electrical intercoupling is, however, so high that electrodes 12 are effectively electrically insulated from one another. Layer 18 provides a resistance of at least $10^6$ ohms, typically $10^{10}$ ohms, between each emitter electrode 12 and each overlying electron-emissive element.

When the removal of cross-over short-circuit defects is performed by selectively cutting parts of emitter electrodes 12 using light energy that impinges (a) on the top side of the largely finished electron-emitting device and (b) then on resistive layer 18 above the emitter-electrode cut locations, layer 18 transmits a substantial fraction of the incident light energy. Alternatively, layer 18 may be patterned so that the resistive material of layer 18 is not present above the emitter-electrode cut locations.

A transparent dielectric layer 20 normally overlies resistive layer 18. Dielectric layer 20 typically consists of silicon oxide having a thickness of 0.1–0.5 $\mu$m.

An array of rows and columns of laterally separated sets of electron-emissive elements 22 are situated in openings 24 extending through dielectric layer 20. Each row of the sets of electron-emissive elements 22 overlies a corresponding one of emitter electrodes 12. In particular, each set of elements 22 occupies an emission region that wholly overlies a designated region 12D of rail 12A of corresponding electrode 12. Each designated region 12D laterally bounds the downward projection of the corresponding set of elements 22 along corresponding electrode 12. As seen in plan view, the lateral boundary (perimeter) of each designated region 12D is therefore the outside lateral boundary of the corresponding set of elements 22. Since the sets of elements 22 are arranged in rows and columns, designated regions 12D are arranged in an array of rows and columns. FIG. 3 illustrates two designated regions 12D in dotted line.

Each designated region 12D of each emitter electrode 12 is associated with a different corresponding one of emitter-electrode openings 16 in that electrode 12. As indicated in FIG. 3, each designated region 12D is normally laterally separated from corresponding emitter-electrode opening 16. Nonetheless, each region 12D can extend all the way to corresponding opening 16. Likewise, each region 12D is normally laterally separated from outer longitudinal edge 14A of that region's electrode 12 but can extend all the way to that longitudinal edge 14A.

Each designated region 12D of each emitter electrode 12 has a centroid 12P, by area, that lies in an emitter-electrode portion situated between imaginary straight lines 26A and 26B that extend in the column direction respectively through the transverse edges (ends) 28A and 28B of corresponding emitter-electrode opening 16 as shown in FIG. 3. That is, as viewed in the column direction and thus perpendicular to the row direction in which the rows of emitter-electrode openings 16 extend, areal centroid 12P of each designated region 12D lies between the ends length-wise of corresponding emitter-electrode opening 16.

In addition to centroid 12P of each designated region 12D lying between straight lines 26A and 26B associated with that region 12D, all of each designated region 12D normally lies between associated lines 26A and 26B. Although none of emitter-electrode openings 16 appear in the cross section of FIG. 2*a*, items 28C and 28D in FIG. 2*a* respectively indicate the locations of transverse edges 28A and 28B of left-hand emitter-electrode opening 16 relative to the row direction. As FIG. 2*a* illustrates, left-hand designated region 12D lies between, and is laterally spaced apart from, locations 28C and 28D for corresponding left-hand emitter-electrode opening 16.

More generally, each emitter-electrode opening 16 has at least a pair of points, referred to here generally as extreme points, most separated in the row direction. When, as in the example of FIGS. 1 and 3, each opening 16 has straight parallel transverse edges 28A and 28B extending in the column direction, all of the infinite number of points of that opening's transverse edge 28B are most separated in the row direction from all of the infinite number of points of that opening's transverse edge 28A. However, each opening 16 can be laterally reconfigured so that either of its transverse edges 28A and 28B is replaced with a surface having a finite (rather than infinite) number of points most separated from the other of transverse edges 28B and 28A in the row direction. Likewise, both of transverse edges 28A and 28B of each opening 16 can be replaced with such surfaces.

When emitter-electrode openings 16 are laterally reconfigured in the preceding way, each so-reconfigured opening 16 has, at the minimum, two points most separated in the row direction. This situation arises, for example, when openings 16 are shaped like ellipses in plan view. This situation also arises when, as seen in plan view, openings 16 are shaped like curved rectangles with fully convex transverse edges. At the minimum, each emitter-electrode opening 16 thus has a pair of extreme points respectively located at opposite transverse edges of that opening 16 and spaced furthest apart in the row direction.

Regardless of how emitter-electrode openings 16 are configured, imaginary lines 26A and 26B for each emitter-electrode opening 16 respectively extend through the pair of extreme points most separated in the row direction for that opening 16. In general, centroid 12P of each designated region 12D thus lies between lines 26A and 26B extending perpendicular to the row direction respectively through the two extreme points located at the transverse edges of corresponding opening 16 and most separated in the row direction. Furthermore, largely all of each designated region 12D normally lies between, and is spaced laterally apart from, lines 26A and 26B that extend through the two extreme points at the transverse edges of corresponding opening 16.

The particular electron-emissive elements 22 overlying each emitter electrode 12 are electrically coupled to that electrode 12 through resistive layer 18. Electron-emissive elements 22 can be shaped in various ways. In the example of FIGS. 2*a* and 2*c*, elements 22 are generally conical in shape. When elements 22 are configured as cones, elements 22 typically consist of molybdenum.

A group of composite opaque laterally separated control electrodes 30 are situated on dielectric layer 20. Control electrodes 30 extend generally parallel to one another in the column direction and thus constitute column electrodes. Each control electrode 30 controls one column of sub-pixels. Three consecutive control electrodes 30 thus control one column of pixels. Control electrodes 30 cross over emitter electrodes 12 in a generally perpendicular manner. Each control electrode 30 overlies a corresponding one of designated regions 12D of each emitter electrode 12.

Also, each control electrode 30 crosses over a corresponding one of emitter-electrode openings 16 in each emitter electrode 12. Each emitter-electrode opening 16 extends laterally beyond electrode 30 which crosses over that opening 16. In particular, each electrode 30 has a pair of opposite longitudinal control edges 32A and 32B extending generally in the column direction. Longitudinal edges 32A and 32B of each electrode 30 respectively correspond to transverse edges 28A and 28B of each opening 16 below that electrode 30. As shown in FIGS. 1 and 2*b*, transverse edges 28A and 28B of each opening 16 respectively extend further laterally away in the row direction along that opening 16 at the associated cross-over location than longitudinal edges 32A and 32B of electrode 30 crossing over that opening 16.

Each control electrode 30 normally consists of a main control portion 34 and a group of adjoining gate portions 36 equal in number to the number of emitter electrodes 12. Main control portions 34 extend fully across the field emitter in the column direction. The lateral boundaries of main portions 34 are indicated in dotted line in FIG. 1. Gate portions 36 are partially situated in large control openings 38 extending through main control portions 34 directly above designated regions 12D of emitter electrodes 12. Electron-emissive elements 22 are exposed through gate openings 40 in the segments of gate portions 36 situated in control openings 38.

Large control openings 38 laterally bound, and therefore define, the electron-emission regions for the laterally separated sets of electron-emissive elements 22. Hence, each control opening 38 is sometimes referred to as a "sweet spot". Designated regions 12D are also laterally defined by control openings 38.

Gate portions 36 partially overlie main control portions 34 in the example of FIGS. 2*a* and 2*c*. Alternatively, main portions 34 can partially overlie gate portions 36. In either case, gate portions 36 are considerably thinner than main portions 34. Main portions 34 typically consist of chromium having a thickness of 0.2 $\mu$m. Gate portions 36 typically consist of chromium having a thickness of 0.04 $\mu$m.

Each control electrode 30 is of minimum width over each rail 12B, of somewhat greater width over each rail 12A, and of even greater width elsewhere. The width of each control electrode 30 is normally 20–40 $\mu$m, typically 30 $\mu$m, above rails 12A and normally 5–30 $\mu$m, typically 20 $\mu$m, above rails 12B. The reduced control-electrode width over emitter electrodes 12 lowers the cross-over capacitance. Similarly, the minimum widths of electrodes 12 occur where control electrodes 30 cross over electrodes 12. This further lowers the cross-over capacitance.

An electron-focusing system 42, generally arranged in a waffle-like pattern as seen in plan view, is situated on parts of main control portions 34 and on adjacent parts of dielectric layer 20. Referring to FIGS. 2*a*–2*c*, electron-focusing system 42 is formed with an electrically non-conductive base focusing structure 44 and a thin electrically non-insulating focus coating 46 situated over part of base focusing structure 44. Since focus coating 46 is thin and generally follows the lateral contour of base focusing structure 44, only the plan view of base structure 44 is illustrated in FIG. 1.

Base focusing structure 44 normally consists of electrically insulating material but can be formed with electrically resistive material of sufficiently high resistivity as to not cause control electrodes 30 to be electrically coupled to one another. Focus coating 46 normally consists of electrically conductive material, typically metal such as aluminum having a thickness of 100 nm. The sheet resistance of focus coating 46 is typically 1–10 ohms/sq. In certain applications, focus coating 46 can be formed with electrically resistive material. In any event, focus coating 46 is generally of lower electrical resistivity than base structure 44. Alternatively, focusing system 42 can consist of an upper electrically conductive portion and a lower, typically shorter (or thinner) electrically insulating portion.

Base focusing structure 44 has a group of focus openings 48, one for each different set of electron-emissive elements 22. Focus openings 48 are respectively approximately concentric with, and larger than, corresponding large control openings (sweet spots) 38. Also, each focus opening 48 is located above largely all of the area where one of control electrodes 30 crosses over one of emitter electrodes 12. The lateral dimension of focus openings 48 in the row direction is normally 60–100 $\mu$m, typically 80 $\mu$m. The lateral dimension of openings 48 in the column direction is normally 100–250 $\mu$m, typically 200 $\mu$m.

Focusing system 42 extends considerably above, typically in the vicinity of 50 $\mu$m above, dielectric layer 20 and thus considerably above electron-emissive elements 22. Focus coating 46 lies on top of structure 44 and extends partway into, typically up to 50–75% of the way into, focus openings 48. Although base structure 44 contacts control electrodes 30, focus coating 46 is everywhere spaced apart from electrodes 30. As seen in plan view, each different set of electron-emissive elements 22 is laterally surrounded by base structure 44 and therefore by focus coating 46.

Focusing system 42, primarily focus coating 46, focuses electrons emitted from each different set of electron-emissive elements 22 so that the emitted electrons impinge on phosphor material in the corresponding light-emissive element of the light-emitting device situated opposite the electron-emitting device. For this purpose, focus coating 46 receives a suitable low focus-control potential, typically constant, during display operation.

The internal pressure in the final flat-panel display that contains the field emitter of FIGS. 1 and 2*a*–2*c* is very low, typically in the vicinity of $10^{-7}$ torr or less. With baseplate 10 being thin, focusing system 42 also serves as a surface contacted by spacers, typically spacer walls, that enable the display to resist external forces such as air pressure while maintaining a desired spacing between the electron-emitting and light-emitting parts of the display.

The field emitter of FIGS. 1 and 2*a*–2*c* is typically fabricated in generally the following manner. Emitter electrodes 12 are formed on baseplate 10, followed by resistive layer 18, and dielectric layer 20. Main control portions 34 are created, followed by gate portions 36. If gate portions 36 are to underlie, rather than overlie, segments of main control portions 34, the last two operations are reversed.

At this point, various manufacturing techniques and sequences can be utilized to form dielectric openings 24, electron-emissive elements 22, and focusing system 42. For example, base focusing structure 44 can be created primarily from photopolymerizable polyimide. Gate openings 40 and dielectric openings 24 can be created respectively in gate portions 36 and dielectric layer 20 according to a charged-particle tracking procedure of the type described in U.S. Pat. No. 5,559,389 or 5,564,959. Electron-emissive elements 22 are created as cones by depositing electrically conductive material through gate openings 40 and into dielectric openings 44. Excess emitter-cone material that accumulates over the structure is removed. Finally, focus coating 46 is formed on base focusing structure 44.

In subsequent operations, the field emitter of FIGS. 1 and 2*a*–2*c* is assembled through an outer wall to a light-emitting device to form a flat-panel CRT display. The assembly procedure is conducted in such a way that the assembled, sealed display is at a very low internal pressure, again typically $10^{-7}$ torr or less. During the assembly procedure, a spacer system is typically inserted between the electron-emitting and light-emitting devices to resist external forces, such as air pressure, exerted on the display.

Cross-over short-circuit defects can occur between control electrodes 30, on one hand, and emitter electrodes 12, on the other hand, during fabrication of the present electron-emitting device. Moving to FIG. 4, it qualitatively illustrates an example of a cross-over short circuit between one control electrode 30 and one emitter electrode 12 in a segment of the portion of the field emitter in FIGS. 1 and 2*a*–2*c*. The cross section of FIG. 4 is taken along the same plane (2*a*—2*a*) in FIG. 1 as the cross section of FIG. 2*a*.

Figure 4:
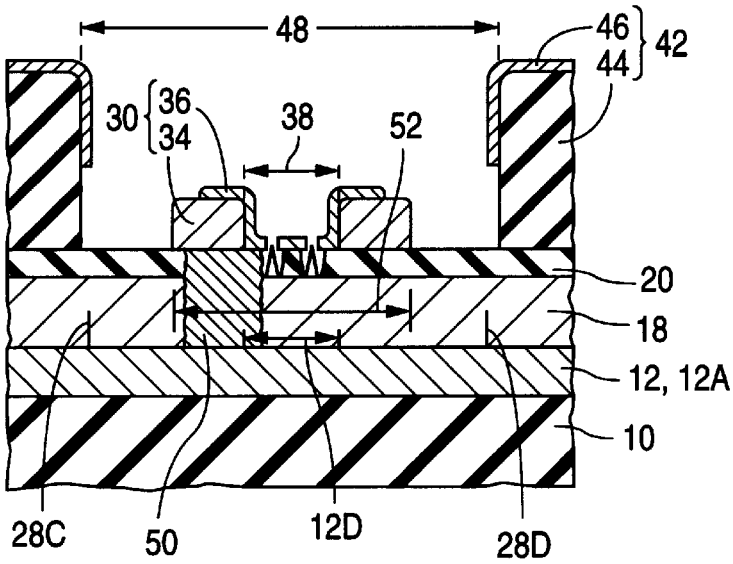
FIGS. 4 and 5 are simplified cross-sectional side views of a short-circuited segment of the portion of the electron-emitting device of FIG. 1 respectively before and after repairing the short-circuit defect. The cross-sections of FIGS. 4 and 5 are taken along plane 2*a*—2*a*.

The cross-over short circuit illustrated in FIG. 4 is directly formed by electrically conductive material 50 that extends through dielectric layer 20 and resistive layer 18 to connect illustrated control electrode 30 to illustrated emitter electrode 12. Although conductive material 50 is shown as being distinct from column electrode 30, conductive material 50 may consist of part of the conductive material employed to create electrodes 30.

Occasionally, one of electron-emissive elements 22 in one of the sets of elements 22 becomes electrically connected to corresponding gate portion 36. If resistive layer 18 were absent, such an electrical connection might be classified as a short circuit. However, due to the high resistance that layer 18 provides between emitter electrodes 12 and overlying electron-emissive elements 22, the amount of current that can flow through a column electrode 30 due to one of its electron-emissive elements 22 being connected to a gate portion 36 is extremely small compared to the current that flows through a direct short circuit such as that represented by conductive material 50. Accordingly, the electrical connection of a gate portion 36 to one of its electron-emissive elements 22 is normally not classified as a short circuit defect to be removed according to the invention. Nonetheless, a direct connection between a gate portion 36 and an associated element 22 could be classified as a short-circuit defect and, if desirable or necessary for some reason, could be removed in the way described below for removing the cross-over short circuit caused by conductive material 50.

Short circuits can be detected at various points during the fabrication of a flat-panel display that utilizes the present field emitter. For example, short circuits are typically detected during testing of the field emitter subsequent to fabrication but before the field emitter is assembled (through the outer wall) to the light-emitting device to form the flat-panel display. Short-circuit detection can also be conducted after display assembly. With the field emitter configured in the present manner, the short-circuit removal technique of the invention can be performed before or after display assembly to remove a cross-over short-circuit defect in the field emitter. This corrective test is sometimes referred to as short-circuit repair. Removing or repairing short-circuit defects increases the yield of good flat-panel displays and thus is important to display fabrication and test.

Ideally, a short-circuit defect is removed in such a manner that no loss in performance is incurred. Nonetheless, display performance is often satisfactory when a few pixels or sub-pixels are partially or totally inoperative, provided that the remainder of the flat-panel display operates in the intended manner. Accordingly, removing a short-circuit defect in a way that causes a pixel or sub-pixel to be inoperative is often acceptable, again provided that the operation of the remainder of the display is largely unaffected and also provided that the number of removed short-circuit defects is not too high.

The asymmetric ladder shape of each emitter electrode 12 facilitates removal of cross-over short-circuit defects from the present field emitter without causing its performance to be impaired except that the set of electron-emissive elements 22 at the site of a cross-over short-circuit defect normally become inoperative. When each electrode 12 is configured in the manner described above so that rails 12A having designated regions 12D are considerably wider than rails 12B, the large majority of cross-over short-circuit defects occur where control electrodes 30 cross over rails 12A. The reason is that the area where electrodes 30 overlap rails 12A is much greater than the area where electrodes 30 overlap rails 12B. For the typical dimensions given above for electrodes 12 and 30, particularly main control electrodes 34, the percentage of cross-over short-circuit defects that occur where electrodes 30 overlie rails 12A is usually in the vicinity of 90% or more of the total number of cross-over short-circuit defects.

The area where each control electrode 30 overlaps each rail 12A is hereafter generally referred to as the primary cross-over area and is identified by reference symbol 52. In FIGS. 1 and 3, primary cross-over area 52 is indicated in slanted shading for left-hand control electrode 30. Primary cross-over area 52 is indicated by arrows for left-hand electrode 30 in FIG. 2*a* and also by arrows for the only electrode 30 shown in FIGS. 2*c* and 4.

In the present invention, repair of short-circuit defects, whether performed before or after display assembly, is initiated by examining the field emitter to identify any control-electrode-to-emitter-electrode cross-over location where a short-circuit defect appears to be present. Subject to the variation described below, a cutting operation is then performed on each so-identified emitter electrode 12 to separate emitter-electrode material underlying primary cross-over area 52 at each identified cross-over short-circuit location from the remainder of that electrode 12. The cutting operation is performed across rail 12A between longitudinal edge 14A and emitter-electrode opening 16 at each identified cross-over short-circuit location.

The examination of the field emitter to locate any cross-over short-circuit defect is performed electrically, optically, or according to a combination of electrical and optical techniques. In a typical examination procedure, a global check is first performed to determine whether the field emitter appears to have at least one cross-over short circuit. The global check entails placing a suitable voltage between main control electrodes 34, on one hand, and emitter electrodes 12, on the other hand, and using a current-measuring device such as an ammeter to determine how much total current flows through electrodes 12 or 30. If the total current is below a threshold level, the field emitter is classified as having no cross-over short-circuit defect.

If the total current exceeds the threshold level, the field emitter is classified as appearing to have one or more cross-over short-circuit defects. The field-emitter is then examined optically and/or electrically to determine the location of each cross-over short circuit. For instance, the procedure and magnetic-sensing equipment described in Field et al, U.S. patent application Ser. No. 08/903,022, filed Jul. 30, 1997, now allowed, can be utilized to determine each cross-over short-circuit location.

Figure 5:
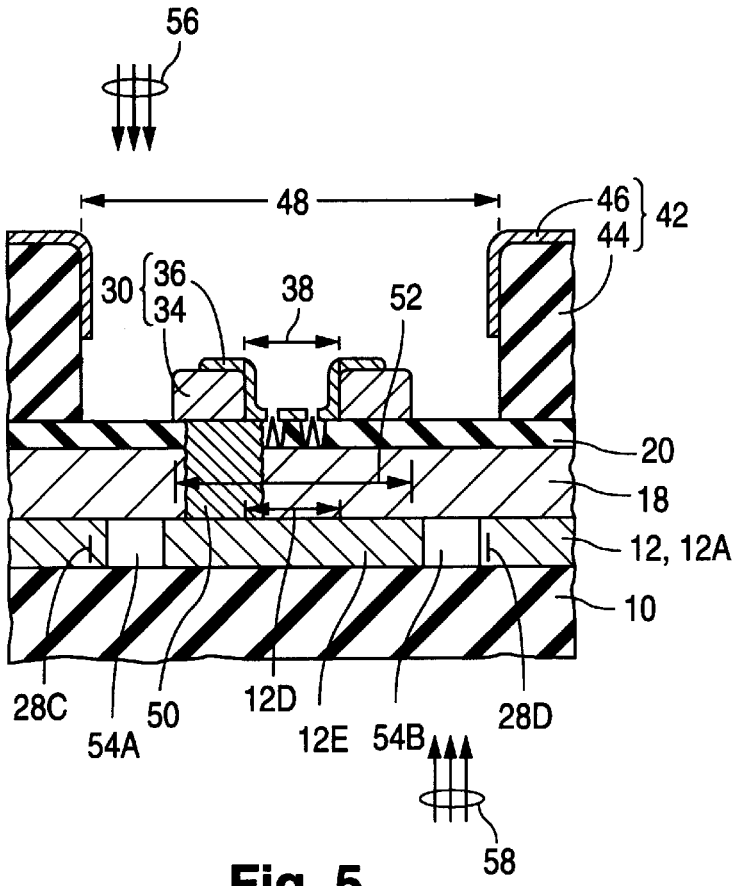
Figure 6:
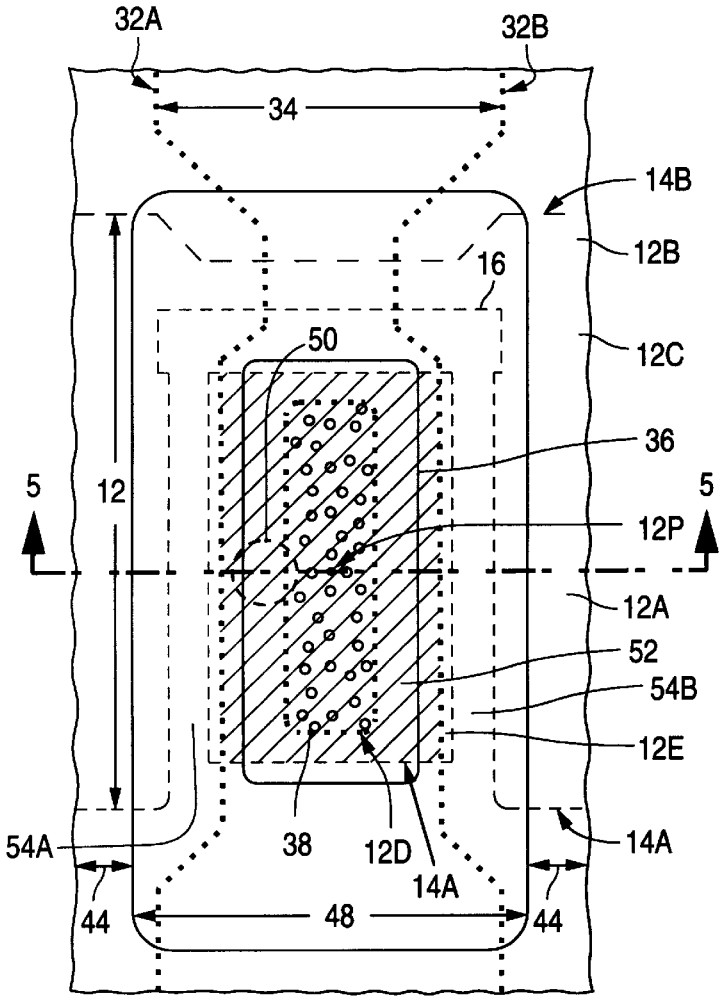
FIG. 6 is a plan view of the short-circuited segment of the portion of the electron-emitting device of FIG. 1 after short-circuit defect repair. The cross section of FIG. 5 is taken through plane 5—5 in FIG. 6.
Figure 7:
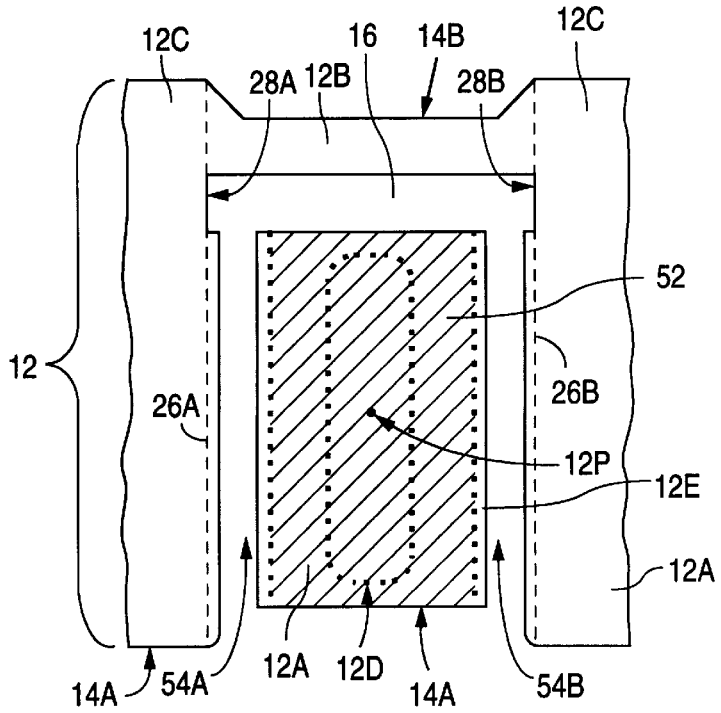
FIG. 7 is a plan view of the emitter electrode in the short-circuited segment of the portion of the electron-emitting device of FIG. 1 after short-circuit defect repair.

Assuming that a particular control-electrode-to-emitter-electrode cross-over location is identified as apparently having a short-circuit defect but the defect does not appear to occur at rail 12B at the identified cross-over location, the present cutting procedure is implemented to remove an emitter-electrode portion underlying primary cross-over area 52 at the identified location as illustrated in FIGS. 5, 6, and 7. FIG. 5 qualitatively depicts how the short-circuited segment of the portion of the field emitter in FIG. 4 appears subsequent to repair of cross-over short-circuit defect 50.

FIG. 6 is a plan view of the repaired field-emitter segment of FIG. 5. FIG. 7 shows the portion of repaired emitter electrode 12 in FIGS. 5 and 6.

The repair procedure entails cutting across rail 12A of short-circuited emitter electrode 12 at two cut locations 54A and 54B on opposite sides of short-circuited control electrode 30, and thus on opposite sides of designated region 12D underlying that electrode 30 in short-circuited electrode 12. Each of cut locations 54A and 54B extends from longitudinal edge 14A of short-circuited electrode 12 to emitter-electrode opening 16 at the cross-over location. Consequently, a portion 12E of rail 12A of emitter electrode 12 under repair is separated from (the remainder of) that electrode 12. Separated emitter-electrode portion 12E is bounded by cut locations 54A and 54B, longitudinal edge 14A, and emitter-electrode opening 16 at the cross-over short-circuit location. Since cut locations 54A and 54B are on opposite sides of short-circuited control electrode 30, separated emitter-electrode portion 12E encompasses primary cross-over area 52 at the identified cross-over location. If, as in the large majority of cases and as depicted in the example of FIGS. 4–6, short-circuit defect 50 falls within primary cross-over area 52 at the identified cross-over location, separation of electrode portion 12E from emitter electrode 12 under repair removes the cross-over short-circuit defect.

The cuts at locations 54A and 54B are made with a beam of focused energy, typical light (or optical) energy provided by a laser or focused lamp. When the short-circuit repair procedure is conducted before display assembly, the cuts can be made by directing the beam of focused energy through the top or bottom side of the field emitter. When the repair procedure is performed after display assembly, the cuts are normally made by directing the energy beam through the bottom side of the field emitter.

Item 56 in FIG. 5 indicates a beam of light energy that impinges on the top side of the field emitter for making the cut at location 54A. Since focus openings 48 are located above largely all the area where control electrodes 30 cross over emitter electrodes 12, light beam 56 passes through focus opening 48 at the cross-over short-circuit location without being hindered by focusing system 42. Inasmuch as dielectric layer 20 is transparent and resistive layer 18 transmits a large percentage of incident light energy, light beam 56 also passes through layers 20 and 18 to make the cut at location 54A. Resistive layer 18 can, as indicated above, be patterned so that the resistive material of layer 18 is not present at cut locations 54A and 54B, thereby avoiding the passage of light energy through layer 18. Item 58 in FIG. 5 indicates a beam of light energy that impinges on the bottom side of the device, passes through transparent baseplate 10, and makes the cut at location 54B.

Due to the cuts made at locations 54A and 54B, electron-emissive elements 22 overlying designated region 12D in separated electrode portion 12E are disabled. However, the cuts do not extend into rail 12B of emitter electrode 12 under repair. Accordingly, rail 12B remains intact at the repaired cross-over short-circuit location. The width and length of rail 12B of each emitter electrode 12 are sufficient to carry all the current that needs to flow through that electrode 12 during display operation. Hence, rail 12B of each repaired emitter electrode 12 conducts current across the repaired cross-over short-circuit location. Also, control electrode 30 remains fully intact over the repaired cross-over short-circuit location. Accordingly, the field emitter is operative except at the location of each repaired cross-over short-circuit defect.

If it is initially determined, normally by optical examination, that a cross-over short-circuit defect appears to occur between a control electrode 30 and rail 12B of emitter electrode 12 at a cross-over location but not between that electrode 30 and rail 12A at the cross-over location, the complement of the repair procedure described above can be employed on short-circuited rail 12B. That is, cuts are made across that rail 12B at two cut locations on opposite sides of short-circuited control electrode 30. Each of these cuts extends between longitudinal edge 14B of emitter electrode 12 under repair and emitter-electrode opening 16 at the cross-over location. A portion of rail 12B of emitter electrode 12 under repair is thereby separated from (the remainder of) that electrode 12 to remove the short-circuit defect. The separated emitter-electrode portion is bounded by the two cut locations, longitudinal edge 14B, and emitter-electrode opening 16 at the repaired cross-over short-circuit location.

The cuts across rail 12B in the complementary repair procedure are performed in the manner described above for cutting across rail 12A. In this case, electron-emissive elements 22 overlying designated region 12D of emitter electrode 12 under repair are not disabled. During display operation, current passes through rail 12A at the repaired cross-over short-circuit location. The repair of short-circuit defect between a control electrode 30 and a rail 12B thus has no significant effect on display operation.

Figure 8:
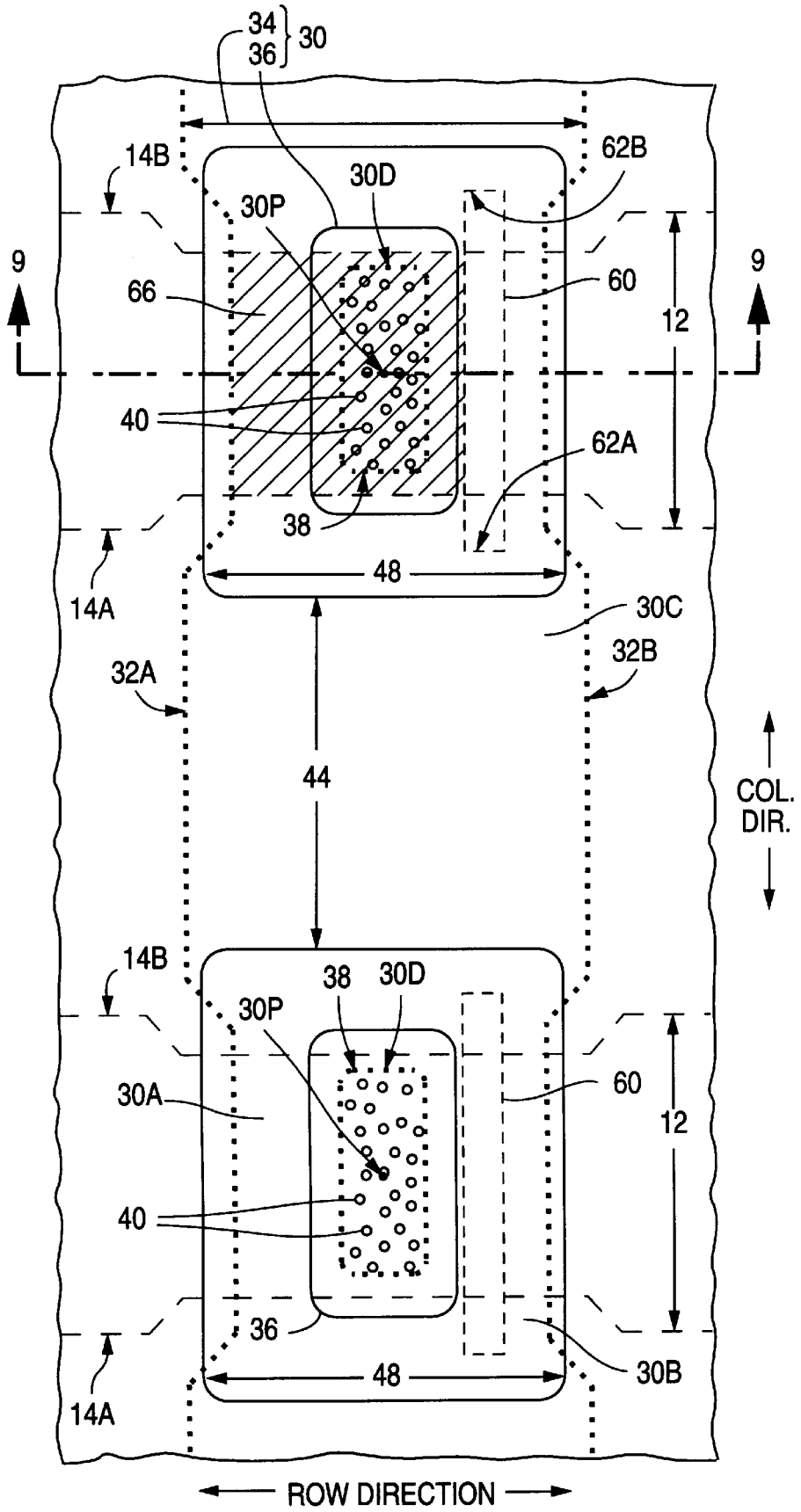
FIG. 8 is a plan view of a portion of an electron-emitting device configured according to the invention to have a control electrode generally shaped like an asymmetric ladder.
Figure 9:
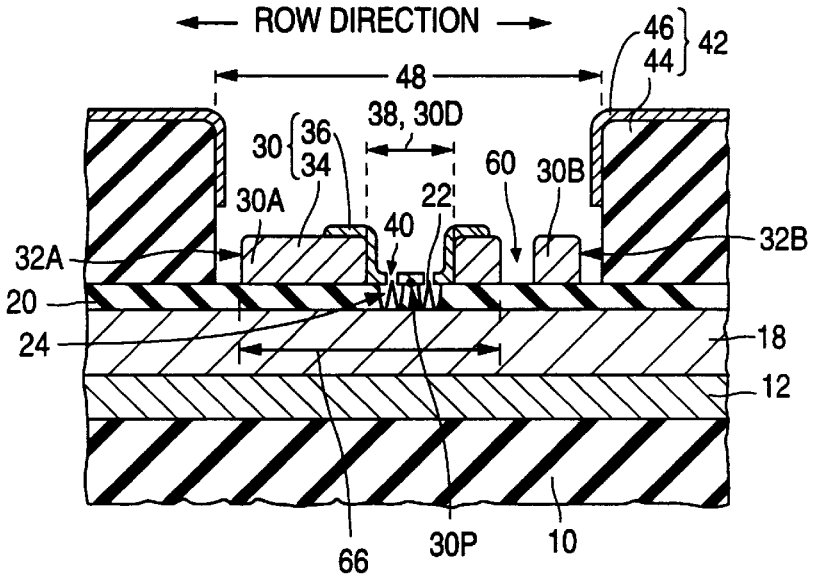
FIG. 9 is a cross-sectional side view of a portion of the electron-emitting device in FIG. 8. The cross section of FIG. 9 is taken through plane 9—9 in FIG. 8.

FIG. 8 illustrates a plan view of part of a variation of the matrix-addressed gated field emitter of FIGS. 1 and 2*a*–2*c* in which control electrodes 30, rather than emitter electrodes 12, are configured according to the invention to facilitate removal of cross-over short-circuit defects. FIG. 9 presents a side cross section of the part of the field emitter shown in FIG. 8. Except for changes in the shapes of electrodes 12 and 30 and accompanying changes in lateral dimensions, the field emitter of FIGS. 8 and 9 is configured basically the same as the field emitter of FIGS. 1 and 2*a*–2*c*. Accordingly, the following description of the field emitter of FIGS. 8 and 9 deals primarily with the features that differ from those of the field emitter of FIGS. 1 and 2*a*–2*c*.

Figure 10:
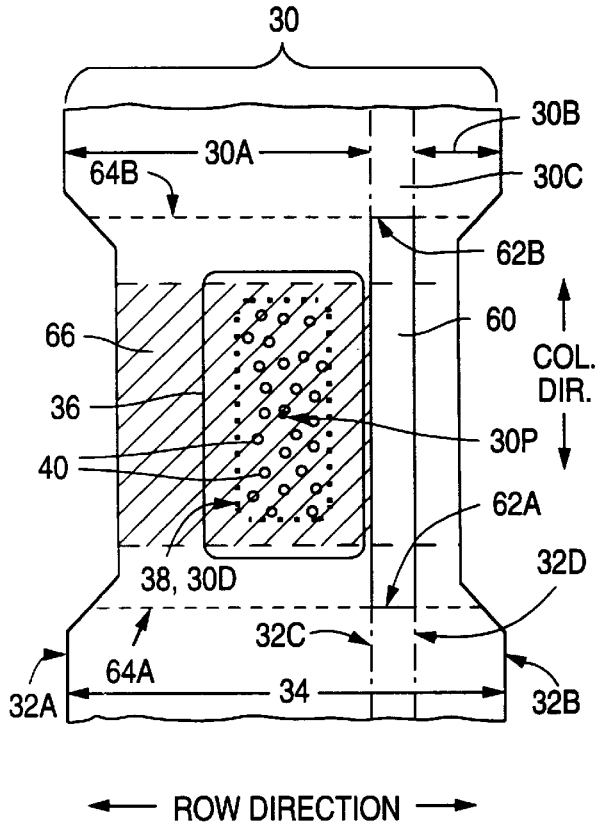
FIG. 10 is a plan view of a segment of the portion of one of the control electrodes in the electron-emitting device of FIG. 8.

Emitter electrodes 12 in the field emitter of FIGS. 8 and 9 do not have emitter-electrode openings 16 and thus are not shaped like asymmetric ladders. Instead, each of control electrodes 30 in the field emitter of FIGS. 8 and 9 is generally in the shape of an asymmetric ladder consisting of a pair of generally parallel rails 30A and 30B and a group of crosspieces 30C that extend between rails 30A and 30B. FIG. 10, oriented the same as FIG. 8, depicts the plan-view shape of part of one of these control electrodes 30 more clearly. The internal lateral extents of rails 30A and 30B and crosspieces 30 are indicated by dot-and-dash lines in FIG. 10.

Rails 30A and 30B of each control electrode 30 extend in the column direction. Longitudinal edges 32A and 32B of each control electrode 30 respectively form the outer longitudinal edges of rails 30A and 30B of that electrode 30. Rail 30A is of considerably greater average width, as measured in the row direction, than rail 30B.

Each crosspiece 30C has a pair of opposite edges which, as shown in FIG. 10, merge seamlessly into rails 30A and 30B along inner longitudinal edges 32C and 32D of each control electrode 30. The regions between crosspieces 30C of each electrode 30 constitute primary control-electrode openings 60 that extend fully through that electrode 30. Primary control-electrode openings 60 of each electrode 30 are laterally separated from one another in the column direction. Control-electrode openings 60 are located in main control portions 34. Electrodes 30 also have gate openings 40 through which electron-emissive elements 22 are exposed.

In the example of FIGS. 8 and 9, primary control-electrode openings 60 of each control electrode 30 are generally rectangular and extend in a line to form a column. Since rail 30A is wider than rail 30B, control-electrode openings 60 are offset relative to electrode 30. In other words, openings 60 are closer to outer longitudinal edge 32B than to outer longitudinal edge 32A. Openings 60 are all of approximately the same dimensions.

The emission region occupied by each set of electron-emissive elements 22 is laterally bounded by a designated region 30D of a corresponding one of control electrodes 30. As with designated regions 12D, designated regions 30D are arranged in an array of rows and columns. Designated regions 30D are defined by large control openings 38. FIG. 10 illustrates one designated region 30D.

Each designated region 30D of each control electrode 30 is associated with a different corresponding one of control-electrode openings 60 in that electrode 30. Each designated region 30D is laterally separated from corresponding opening 60 and also from longitudinal edge 32A of that region's electrode 30. However, each region 30D can extend all the way to that longitudinal edge 32A.

Each control-electrode opening 60 has (at least) a pair of points, referred to here as extreme points, most separated in the column direction. Each opening 60 also has straight parallel transverse edges 62A and 62B that respectively extend through the pair of extreme points for that opening 60.

Each designated region 30D has a centroid 30P, by area, situated between imaginary straight lines 64A and 64B that extend in the row direction respectively through the pair of extreme points for corresponding opening 60 and thus respectively through its transverse edges 62A and 62B. Longitudinal edges 14A and 14B of each emitter electrode 12 respectively correspond to transverse edges 62A and 62B. As shown in FIG. 8, transverse edges 62A and 62B of each opening 60 respectively extend further laterally away in the column direction along that opening 60 at the associated control-electrode-to-emitter-electrode cross-over location than corresponding longitudinal edges 14A and 14B. In addition to areal centroid 30P of each designated region 30D lying between straight lines 64A and 64B associated with that region 30D, all of each designated region 30D normally lies between, and is spaced laterally apart from, associated lines 64A and 64B.

The area where each rail 30A of each control electrode 30 overlies an emitter electrode 12 is hereafter generally referred to as the primary cross-over area and is identified by reference symbol 66. Primary cross-over area 66 is indicated in slanted shading for upper emitter electrode 12 in FIG. 8 and for the only emitter electrode 12 in FIG. 10. In FIG. 9, cross-over area 66 is indicated by arrows. At each cross-over location, cross-over area 66 is much greater than the area where associated rail 30B overlies emitter electrode 12. Consequently, a large majority of cross-over short-circuit defects occur at cross-over areas 66.

Figure 11:
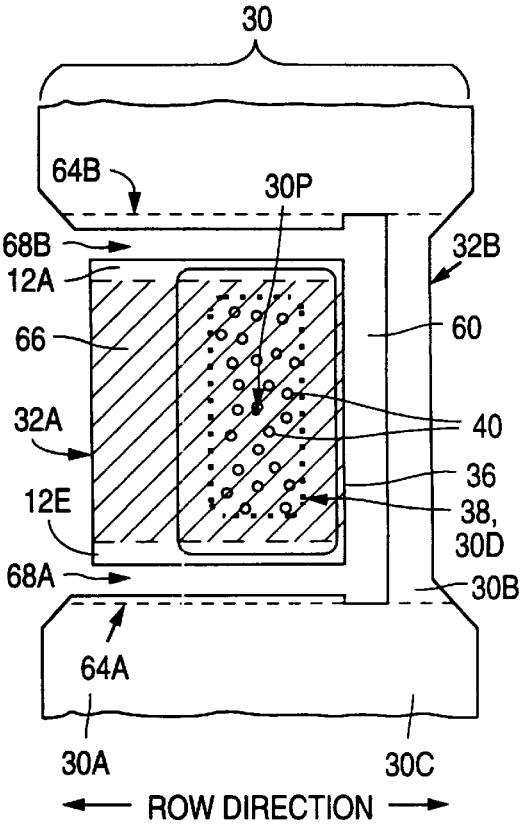
FIG. 11 is a plan view of the control electrode in a short-circuited segment of the portion of the electron-emitting device of FIG. 1 after short-circuit defect repair.

Except for the fact that cuts are performed, as necessary, on control electrodes 30 rather than emitter electrodes 12, corrective test to repair any control-electrode-to-emitter-electrode cross-over short circuit in the field emitter of FIGS. 8 and 9 is performed in largely the same way as in the field emitter of FIGS. 1 and 2*a*–2*c*. Consider the typical situation in which a particular cross-over location is identified as having a short-circuit defect but the defect is not determined to occur at rail 30B at the identified location. FIG. 11, corresponding to FIG. 10, illustrates how a segment of one control electrode 30 appears after performing short-circuit repair at the identified cross-over location.

The procedure for repairing the short-circuit defect consists of cutting across rail 30A of short-circuited control electrode 30 at two cut locations 68A and 68B on opposite sides of short-circuited emitter electrode 12, and thus on opposite sides of designated region 30D of that control electrode 30. Each of cut locations 68A and 68B extends from longitudinal edge 32A of short-circuited electrode 30 to control-electrode opening 60 at the cross-over location. A portion 30E of rail 30A of control electrode 12 under repair is separated from (the remainder of) that electrode 30. Separated control-electrode portion 30E is bounded by cut locations 68A and 68B, longitudinal edge 32A, and control-electrode opening 60 at the cross-over short-circuit location. Because cut locations 68A and 68B are on opposite sides of short-circuited emitter electrode 12, primary cross-over area 66 at the cross-over location is part of separated control-electrode portion 30E. If the short-circuit defect occurs at primary cross-over area 66, separation of electrode portion 30E from control electrode 30 under repair removes the cross-over short circuit.

The cuts at locations 68A and 68B are made with a beam of focused energy in the manner described above for repairing an emitter electrode 12 in the field emitter of FIGS. 1 and 2. The energy beam again is typically light energy provided by a laser or a focused lamp. Similar to what is shown in FIG. 5, the cuts can be made through the top or bottom side of the field emitter when the short-circuit repair procedure is conducted before display assembly. In the field emitter of FIGS. 8 and 9, performing the cuts with light energy that impinges on the top side of the field emitter is advantageous because the repaired location is at the top of the field emitter. Nonetheless, the repair procedure can be performed after display assembly. In this case, the energy beam is normally directed through the bottom side of the field emitter.

Rail 30B remains intact at the repaired cross-over short-circuit location to enable repaired control electrode 30 to carry current across the repair site. Emitter electrode 12 is also fully intact at the repair site. The only casualty is the set of electron-emissive elements 22 that extends through gate openings 40 in designated region 30D at the repair site. As with the field emitter of FIGS. 1 and 2, the field emitter of FIGS. 8 and 9 is operable except at the location of each repaired cross-over short-circuit defect.

If an initial determination, normally by optical examination, indicates that a cross-over short-circuit defect appears to occur between emitter electrode 12 and rail 30B of control electrode 30 at a cross-over location but not between that emitter 12 and rail 30A at the cross-over location, the complement of the repair procedure performed on rail 30A can be performed on rail 30B. Cuts are made across rail 30B at two cut locations on opposite sides of short-circuited emitter electrode 12. Each cut extends between longitudinal edge 32B of control electrode 30 under repair and control-electrode opening 60 at the cross-over location. A portion of rail 30B is separated from that control electrode 30. The separated control-electrode portion is bounded by the two cut locations, longitudinal edge 32B, and corresponding control-electrode opening 60. The set of electron-emissive elements 22 remains operative at the repair site.

A flat-panel CRT display containing an electron-emitting device manufactured according to the invention operates in the following way. The anode in the light-emitting device is maintained at high positive potential relative to control electrodes 30 and emitter electrodes 12. When a suitable potential is applied between (a) a selected one of control electrodes 30 and (b) a selected one of emitter electrodes 12, the so-selected gate portion 34 extracts electrons from the selected set of electron-emissive elements 22 and controls the magnitude of the resulting electron current. The extracted electrons pass through the anode layer and selectively strike the phosphor regions, causing them to emit light visible on the exterior surface of the light-emitting device.

Directional terms such as "top", "bottom", and "lateral" have been employed in describing the present invention to establish a frame of reference by which the reader can more easily understand how the various parts of the invention fit together. In actual practice, the components of the present electron-emitting device may be situated at orientations different from that implied by the directional items used here. The same applies to the way in which the fabrication and corrective-test steps are performed in the invention. Inasmuch as directional items are used for convenience to facilitate the description, the invention encompasses implementations in which the orientations differ from those strictly covered by the directional terms employed here.

While the invention has been described with reference to particular embodiments, this description is solely for the purpose of illustration and is not to be construed as limiting the scope of the invention claimed below. For instance, the ladder shape of the electrodes configured to facilitate short-circuit repair according to the invention can differ more from a conventional ladder shape than those of emitter electrodes 12 in the field emitter of FIGS. 1 and 2*a*–2*c* and control electrodes 30 in the field emitter of FIGS. 8 and 9. Emitter-electrode openings 16 can have plan-view shapes other than rectangles, provided that openings 16 are spaced laterally apart in the row direction. Openings 16 in each emitter electrode 12 need not be in a straight line. As an example, openings 16 in each electrode 12 can jump around in a zig-zag pattern. Similar comments apply to primary control-electrode openings 60 in regard to the column direction.

Designated regions 12D likewise can have plan-view shapes other than rectangles and, in each emitter electrode 12, need not be in a straight line. Emitter-electrode openings 16 and designated regions 12D can variously exchange places in that certain of regions 12D can be located between corresponding openings 16 and longitudinal edge 14A of each electrode 12, whereas others of regions 12D are located between corresponding openings 16 and longitudinal edge 14B of that electrode 12. Like comments apply to the shapes of designated regions 30D and their relationship to primary control-electrode openings 60.

Each designated region 12D can be divided into two or more laterally separated portions that underlie corresponding laterally separated portions of electron-emissive elements 22 at each cross-over location. As viewed in the row direction, portions of each region 12D can be located on one side or on both sides of corresponding opening 16. Depending on how regions 12D and openings 16 are arranged relative to one another, each emitter electrode 12 can extend generally in a straight line or can zig-zag in various ways while extending generally in the row direction. Designated regions 30D can each be divided into multiple portions in the same way and can be arranged, relative to control-electrode openings 60, so that control electrodes 30 zig-zag in various ways while extending generally in the column direction.

The location of areal centroid 12P of each designated region 12D may not occur in (the area of) that region 12D. Such a situation can arise when each designated region 12D consists of two or more laterally separated portions. Centroid 12P can then be located between two of the portions. Each designated region 12D can also be shaped like an annulus. In that case, centroid 12P may be located in the opening in the annulus. The same applies to the location of the areal centroid 30P of each designated region 30D.

Depending on how electrodes 12 and 30 are configured, the cuts along one of emitter electrodes 12 to remove a short-circuit defect in the field emitter of FIGS. 1 and 2*a*–2*c* can be performed along cut locations that are not parallel and/or are not straight. For example, the cut locations can be curved. The same applies to the cuts that are made along one of control electrodes 30 in repairing a short circuit in the field emitter of FIGS. 8 and 9.

Electrodes 12 and 30 and designated regions 12D in the field emitter of FIGS. 1 and 2*a*–2*c* can be configured so that each designated region 12D extends laterally beyond parallel imaginary straight lines 26A and 26B that pass through the two extreme row-direction points of corresponding emitter-electrode opening 16 while centroid 12P of that designated region 12D still lies between those lines 26A and 26B. Likewise, electrodes 12 and 30 and designated regions 30D in the field emitter of FIGS. 8 and 9 can be configured so that each designated region 30D extends laterally beyond parallel imaginary straight lines 64A and 64B that pass through the two extreme column-direction points of corresponding primary control-electrode opening 60 although centroid 30P of that designated region 30D lies between those lines 64A and 64B. In such cases, the cuts along an electrode 12 or 30 to repair a cross-over short circuit defect are normally made along non-parallel, typically curved, cut locations.

A field emitter configured according to the invention can have both emitter-electrode openings 16 and primary control-electrode openings 60. Short-circuit repair can then be performed on either of electrodes 12 and 30 at a cross-over location depending on the characteristics of the short-circuit defect. Rather than reducing cross-over capacitance by making electrodes 12 and 30 narrower at the cross-over locations, especially away from designated regions 12D or 30D that laterally bound the sets of electron-emissive elements 22, additional openings can be formed in electrodes 12 or/and 30 away from designated regions 12D or/and 30D to reduce the cross-over area and thus the cross-over capacitance.

The row and column directions can be reversed. Emitter-electrode openings 16 need only be laterally separated in some primary direction regardless of whether that direction is the row or column direction. Likewise, primary column-electrode openings 60 need only be laterally separated in some primary direction.

Control electrodes 30 can cross emitter electrodes 12 at angles significantly different from 90°. Instead of being formed from two layers, each control electrode 30 can be formed from a single layer, i.e., a gate layer, or from three or more layers. Electrodes 30 can be transmissive of light. Dielectric layer 20 can be patterned in various ways. In general, the dielectric material of layer 20 need only be present where control electrodes 30 cross over emitter electrodes 12.

One or more regions in addition to, or in place of, focusing system 42 can be situated on control electrodes 30 and on adjacent portions of dielectric layer 20. On the other hand, resistive layer 18 can be deleted. In this case, a short circuit between a control electrode 30 and an electron-emissive element 22 may be classified as a cross-over short-circuit defect to be removed according to the present invention.

The light energy used to perform short-circuit repair in the invention can arise from visible light, ultraviolet light, or/and infrared light. Focused energy other than light can be used to perform the cutting operation.

Each of the sets of electron-emissive elements 22 can consist of only one element 22 rather than multiple elements 22. Multiple electron-emissive elements can be situated in one opening through dielectric layer 20. Electron-emissive elements 22 can have shapes other than cones. One example is filaments. Another is randomly shaped particles such as diamond grit.

Field emission includes the phenomenon generally known as surface emission. Electron-emissive elements 22 that operate according to field emission can be replaced with electron-emissive elements that operate according to other mechanisms such as thermionic emission or photoemission. In this regard, control electrodes 30 can be replaced with control electrodes that collect electron elements which continuously emit electrons during display operation rather than selectively extracting electrons from electron-emissive elements.

The present field emitter can be used in a black-and-white flat-panel display rather than a color flat-panel display. Also, the present field emitter can be used in a flat-panel display other than a flat-panel CRT display and in a device other than a flat-panel display. Various modifications and applications may thus be made by those skilled in the art without departing from the true scope and spirit of the invention as defined in the appended claims.

We claim:

1. A device comprising:

a unitary emitter electrode having a plurality of emitter-electrode openings spaced laterally apart from one another in a primary direction, each emitter-electrode opening having a pair of extreme points most separated in the primary direction; and a plurality of laterally separated sets of electron-emissive elements electrically coupled to the emitter electrode, each of the sets of electron-emissive elements overlying a corresponding designated region of the emitter electrode, each designated region having a centroid that lies between a pair of lines extending perpendicular to the primary direction respectively through the extreme points of a different corresponding one of the emitter-electrode openings.

2. A device as in claim 1 wherein the emitter electrode comprises:

first and second laterally separated rails extending generally in the primary direction, the designated regions being parts of at least one of the rails; and plural laterally separated crosspieces situated between, and merging into, the rails to define the emitter-electrode openings.

3. A device as in claim 2 wherein the first rail is wider than the second rail, the designated regions all being parts of the first rail.

4. A device as in claim 1 wherein each designated region lies between the pair of lines extending perpendicular to the primary direction through the extreme points of the corresponding emitter-electrode opening.

5. A device as in claim 1 further including electrically resistive material situated between the emitter electrode and each of the sets of electron-emissive elements.

6. A device as in claim 1 further including:

a dielectric layer overlying the emitter electrode and having dielectric openings in which the electron-emissive elements are largely situated; and a plurality of control electrodes overlying the dielectric layer and having control openings through which the electron-emissive elements are exposed, each control electrode extending fully over a different corresponding one of the designated regions.

7. A device as in claim 6 further including a focusing system for focusing electrons emitted by the electron-emissive elements, the focusing system overlying the dielectric layer and having a plurality of focus openings, each located above largely all of where a different corresponding one of the control electrodes overlies the emitter electrode.

8. A device as in claim 6 wherein each control electrode comprises:

a main control portion that crosses over the emitter electrode; and a gate portion situated above the corresponding designated region, contacting the main control portion, and having part of the control openings, each control opening thereby being a gate opening.

9. A device as in claim 1 wherein each designated region comprises multiple laterally separated portions.

10. A device as in claim 9 wherein at least two of the portions of each designated region are located between the corresponding emitter-electrode opening and a specified longitudinal edge of the emitter electrode.

11. A device comprising:

a unitary emitter electrode having a plurality of laterally separated emitter-electrode openings;

a dielectric layer overlying the emitter electrode;

a plurality of laterally separated sets of electron-emissive elements situated above the emitter electrode largely in dielectric openings in the dielectric layer; and a plurality of laterally separated control electrodes overlying the dielectric layer and having control openings through which the electron-emissive elements are exposed, each control electrode crossing over the emitter electrode above a different corresponding one of the emitter-electrode openings and having a pair of opposite outer longitudinal edges beyond both of which the corresponding emitter-electrode opening extends laterally.

12. A device as in claim 11 wherein each of the sets of electron-emissive elements overlies a corresponding designated region of the emitter electrode, each control electrode extending fully over a different corresponding one of the designated regions.

13. A device as in claim 12 wherein the emitter electrode comprises:

a pair of laterally separated rails extending generally in the primary direction, the designated regions being parts of at least one of the rails; and plural laterally separated crosspieces situated between, and merging into, the rails to define the emitter-electrode openings.

14. A device as in claim 13 wherein one of the rails is wider than the other rail, the designated regions all being parts of the wider rail.

15. A device as in claim 14 further including a focusing system for focusing electrons emitted by the electron-emissive elements, the focusing system overlying the dielectric layer and having a plurality of focus openings, each located above largely all of where a different corresponding one of the control electrodes crosses over the wider rail.

16. A device as in claim 11 further including a focusing system for focusing electrons emitted by the electron-emissive elements, the focusing system overlying the dielectric layer and having a plurality of focus openings, each located above largely all of where a different corresponding one of the control electrodes crosses over the emitter electrode.

17. A method comprising the step of providing an electron-emitting device in which a plurality of laterally separated sets of electron-emissive elements overlie a unitary emitter electrode having a plurality of emitter-electrode openings spaced laterally apart from one another in a primary direction such that each emitter-electrode opening has a pair of extreme points most separated in the primary direction, such that each of the sets of electron-emissive elements overlies a corresponding designated region of the emitter electrode, and such that each designated region has a centroid located between a pair of lines extending perpendicular to the primary direction through the extreme points of a different corresponding one of the emitter-electrode openings.

18. A method as in claim 17 wherein the providing step entails providing the electron-emissive elements in dielectric openings of a dielectric layer formed over the emitter electrode, the method further including the step of furnishing the device with a plurality of control electrodes above the dielectric layer such that the control electrodes have control openings through which the electron-emissive elements are exposed and such that each control electrode overlies a corresponding different one of the designated regions.

19. A method as in claim 18 further including the steps of:

examining the device to determine whether any of the control electrodes appears to be short circuited to the emitter electrode; and, if so, cutting partially across the emitter electrode at a pair of cut locations on opposite sides of the designated region corresponding to each so short-circuited control electrode, both cut locations extending between the corresponding emitter-electrode opening and a specified longitudinal edge of the emitter electrode such that an electrode portion containing that designated region is separated from the emitter electrode.

20. A method as in claim 19 wherein the cutting step is performed along emitter-electrode material not underlying each so short-circuited control electrode.

21. A method as in claim 19 wherein the cutting step entails directing light energy selectively on the emitter electrode.

22. A method as in claim 19 further including the step of assembling the device and a light-emitting device to form a display, the cutting step being performed subsequent to the assembling step.

23. A method as in claim 22 wherein the cutting step entails directing light energy selectively on the emitter electrode from below the emitter electrode.

24. A method as in claim 19 wherein the emitter electrode comprises:

first and second laterally separated rails extending generally in the primary direction, the designated regions being part of at least one of the rails; and plural laterally separated crosspieces situated between, and merging into, the rails.

25. A method as in claim 24 wherein the first rail is wider than the second rail, the designated regions all being parts of the first rail.

26. A method as in claim 19 each designated region lies between the pair of lines extending perpendicular to the primary direction through the extreme points of the corresponding emitter-electrode opening.

27. A method of performing corrective test on an electron-emitting device in which a dielectric layer overlies an emitter electrode, laterally separated sets of electron-emissive elements are situated largely in dielectric openings in the dielectric layer, each of the sets of electron-emissive elements overlies a corresponding designated region of the emitter electrode, control electrodes overlie the dielectric layer, and each control electrode is situated over the emitter electrode above a different corresponding one of the designated regions, the method comprising the steps of:

examining the device to determine whether any of the control electrodes appears to be short circuited to the emitter electrodes; and, if so, cutting partially across the emitter electrode at a pair of cut locations on opposite sides of the designated region corresponding to each so-short circuited control electrode, both cut locations extending between a corresponding earlier-provided emitter-electrode opening in the emitter electrode and a specified longitudinal edge of the emitter electrode such that an electrode portion containing that designated region is separated from the emitter electrode.

28. A method as in claim 27 wherein the cutting step is performed along emitter-electrode material not underlying each so short-circuited control electrode.

29. A method of performing corrective test on an electron-emitting device in which an emitter electrode has laterally separated emitter-electrode openings, a dielectric layer overlies the emitter electrode, laterally separated sets of electron-emissive elements are situated above the emitter electrode largely in dielectric openings in the dielectric layer, laterally separated control electrodes overlie the dielectric layer and have control openings through which the electron-emissive elements are exposed, and each control electrode crosses over the emitter electrode above a different corresponding one of the emitter-electrode openings and has a pair of opposite outer longitudinal edges beyond both of which the corresponding emitter-electrode opening extends laterally, the method comprising the steps of:

examining the device to determine whether any of the control electrodes appears to be short circuited to the emitter electrode; and, if so, cutting partially across the emitter electrode at a pair of cut locations on opposite sides of each so short-circuited control electrode, both cut locations extending between the corresponding emitter-electrode opening and a specified longitudinal edge of the emitter electrode such that an electrode portion bounded by the cut locations, the specified longitudinal edge of the emitter electrode, and the corresponding emitter-electrode opening is separated from the emitter electrode.

30. A method as in claim 29 wherein each of the sets of electron-emissive elements overlies a corresponding designated region of the emitter electrode, each control electrode extending fully over a different corresponding one of the designated regions.

31. A method as in claim 30 wherein each emitter electrode comprises:

a pair of generally parallel, laterally separated rails, the designated regions being part of at least one of the rails; and plural laterally separated crosspieces situated between, and merging into, the rails.

32. A method as in claim 31 wherein, along a plane extending through any of the designated regions generally perpendicular to the rails, the rail having that designated region is wider than the other rail.

33. A method as in claim 29 wherein the cutting step entails selectively directing light energy on the emitter electrode.

34. A method as in claim 33 wherein the light energy is directed on the emitter electrode from above the emitter electrode.

35. A method as in claim 33 wherein the light energy is directed on the emitter electrode from below the emitter electrode.

36. A method as in claim 29 further including the step of assembling the device and a light-emitting device to form a display, the cutting step being performed subsequent to the assembling step.

37. A method as in claim 36 wherein the cutting step entails directing light energy selectively on the emitter electrode from below the emitter electrode.

38. A method as in claim 29 wherein the device includes a focusing system for focusing electrons emitted by the electron-emissive elements, the focusing system overlying the dielectric layer and having a plurality of focus openings, each located above largely all of where a different corresponding one of the control electrodes crosses over the emitter electrode.

39. A device comprising:

a control electrode having a plurality of control-electrode openings spaced laterally apart from one another in a primary direction, each control-electrode opening having a pair of extreme points most separated in the primary direction, the control electrode comprising a main control portion and at least one thinner adjoining gate portion having further openings; and a plurality of laterally separated sets of electron-emissive elements exposed through the further openings in the control electrode, each of the sets of electron-emissive elements being laterally bounded by a corresponding designated region of the control electrode, each designated region having a centroid that lies between a pair of lines extending perpendicular to the primary direction through the extreme points of a different corresponding one of the primary control-electrode openings.

40. A device as in claim 39 wherein the control electrode comprises:

first and second laterally separated rails extending generally in the primary direction, the designated regions being parts of at least one of the rails; and plural laterally separated crosspieces situated between, and merging into, the rails to define the primary control-electrode openings.

41. A device as in claim 40 wherein the first rail is wider than the second rail, the designated regions all being parts of the first rail.

42. A device as in claim 41 wherein each designated region lies between the pair of lines extending perpendicular to the primary direction through the extreme points of the corresponding primary control-electrode opening.

43. A device comprising:

a control electrode having a plurality of primary laterally separated control-electrode openings, the control electrode comprising a main control portion and at least one thinner adjoining gate portion having further openings;

a dielectric layer underlying the control electrodes;

a plurality of laterally separated sets of electron-emissive elements situated largely in dielectric openings in the dielectric layer and exposed through further openings in the control electrode; and a plurality of emitter electrodes underlying the electron-emissive elements, each emitter electrode crossing under the control electrode below a different corresponding one of the primary control-electrode openings and having a pair of outer longitudinal edges beyond both of which the corresponding primary control-electrode opening laterally extends.

44. A device as in claim 43 wherein each of the sets of electron-emissive elements is laterally bounded by a corresponding designated region of the control electrode, each emitter electrode extending fully under a different corresponding one of the designated regions.

45. A device as in claim 44 wherein the control electrode comprises:

a pair of laterally separated rails extending generally in the primary direction, the designated regions being parts of at least one of the rails; and plural laterally separated crosspieces situated between, and merging into, the rails to define the primary control-electrode openings.

46. A device as in claim 45 wherein one of the rails is wider than the other rail, the designated regions all being parts of the wider rail.

47. A device as in claim 43 further including a focusing system for focusing electrons emitted by the electron-emissive elements, the focusing system overlying the dielectric layer and having a plurality of focus openings, each located above largely all of where a different corresponding one of the emitter electrodes crosses under the control electrode.

48. A device as in claim 44 wherein:

the main control portion of the control electrode crosses over the emitter electrodes; and each gate portion contains one of the designated regions.

49. A method of performing corrective test on an electron-emitting device in which a control electrode has primary laterally separated control-electrode openings, the control electrode comprises a main control portion and at least one thinner adjoining gate portion having further openings, a dielectric layer underlies the control electrode, laterally separated sets of electron-emissive elements are situated largely in dielectric openings in the dielectric layer and are exposed through the further openings in the control electrode, emitter electrodes underlie the electron-emissive elements, and each emitter electrode crosses under the control electrode below a different corresponding one of the primary control-electrode openings and has a pair of outer longitudinal edges beyond both of which the corresponding primary control-electrode opening laterally extends, the method comprising the steps of:

examining the device to determine whether any of the emitter electrodes appears to be short circuited to the control electrode; and, if so, cutting partially across the control electrode at a pair of cut locations on opposite sides of each so short-circuited emitter electrode, both cut locations extending between the corresponding primary control-electrode opening and a specified longitudinal edge of the control electrode such that an electrode portion bounded by the cut locations, the specified longitudinal edge of the control electrode, and the corresponding primary control-electrode opening is separated from the emitter electrode.

50. A method as in claim 49 wherein each of the sets of electron-emissive elements is laterally bounded by a corresponding designated region of the control electrode, each emitter electrode extending fully under a different corresponding one of the designated regions.

51. A method as in claim 50 wherein the control electrode comprises:

a pair of laterally separated rails extending generally in the primary direction, the designated regions being parts of at least one of the rails; and plural laterally separated crosspieces situated between, and merging into, the rails to define the primary control-electrode openings.

52. A method as in claim 51 wherein one of the rails is wider than the other rail, the designated regions all being part of the wider rail.

53. A method as in claim 49 wherein the cutting step entails selectively directing light energy on the control electrode.

54. A method as in claim 53 wherein the light energy is directed on the control electrode from above the control electrode.

55. A method as in claim 53 wherein the light energy is directed on the control electrode from below the control electrode.

56. A method as in claim 49 further including the step of assembling the device and a light-emitting device to form a display, the cutting step being performed subsequent to the assembling step.

* * * * *